US006089902A

United States Patent [19]

Daoud

[11] Patent Number: 6,089,902

[45] Date of Patent: Jul. 18, 2000

[54] MINIATURE CONNECTOR ASSEMBLY, A MINIATURE CONNECTOR RETROFIT KIT AND A METHOD FOR MAKING AND USING THE SAME

[75] Inventor: Bassel Hage Daoud, Parsippany, N.J.

[73] Assignee: Lucent Technologies, Inc., Murray Hill, N.J.

[21] Appl. No.: 09/201,658

[22] Filed: Dec. 1, 1998

[51] Int. Cl.[7] ..... H01R 11/20

[52] U.S. Cl. ..... 439/409

[58] Field of Search ..... 439/409, 410, 439/864, 261, 266, 341, 372, 389, 395, 725, 713, 888

[56] References Cited

U.S. PATENT DOCUMENTS

| | | | |
|---|---|---|---|
| 4,017,143 | 4/1977 | Knowles | 439/637 |
| 4,714,437 | 12/1987 | Dyki . | |
| 4,904,201 | 2/1990 | Pelletier . | |
| 4,944,695 | 7/1990 | Tsuji et al. . | |
| 4,963,106 | 10/1990 | Wendling et al. . | |
| 4,995,829 | 2/1991 | Geib et al. | 439/409 |
| 5,071,369 | 12/1991 | Denlinger et al. . | |
| 5,273,443 | 12/1993 | Frantz et al. . | |
| 5,453,021 | 9/1995 | Smith . | |
| 5,622,506 | 4/1997 | Hornig et al. . | |
| 5,634,817 | 6/1997 | Siemon et al. . | |
| 5,660,563 | 8/1997 | Chevarie et al. . | |
| 5,667,402 | 9/1997 | Denovich et al. | 439/409 |
| 5,730,624 | 3/1998 | Lester et al. . | |
| 5,785,548 | 7/1998 | Capper et al. | 439/409 |
| 5,807,131 | 9/1998 | Allen et al. . | |

*Primary Examiner*—Gary F. Paumen
*Assistant Examiner*—Ross Gushi
*Attorney, Agent, or Firm*—Dickstein Shapiro Morin & Oshinsky LLP

[57] ABSTRACT

A miniature electrical connector assembly including a plurality of detachable pivoting assemblies arrayed in a housing and anchored to a base. A plurality of pivoting assemblies are formed with a frangible grooved spacer in between. Each pivoting assembly is capable of receiving two electrical wires and two terminals, each terminal having insulation displacement portions. As the pivoting assembly is rotated from the open to the closed position, a wire is guided into a wire interface between sharp edges of a pair of prongs. The sharp edges slice the insulation, creating an electrical connection when the pivoting assembly is in the closed position. The electric wire may be easily removed by pulling on it, thus rotating the pivoting assembly to the open position. Through this arrangement, a wire may be replaced without affecting adjacent connections. The lower portion of the terminal may include a second pair of prongs to receive and create an electrical connection with a second wire. In this embodiment, the housing connects with a connector. This allows for a tool-less replacement of electrical wires.

48 Claims, 10 Drawing Sheets

MINIATURE CONNECTOR ASSEMBLY, A MINIATURE CONNECTOR RETROFIT KIT AND A METHOD FOR MAKING AND USING THE SAME

FIELD OF THE INVENTION

The present invention relates generally to miniature connectors, and more particularly, to an apparatus and process for assembling a plurality of miniature connectors.

BACKGROUND OF THE INVENTION

Electrical connectors have become widely accepted as a preferred mechanism for interconnecting the circuitry components of electrically operated products and equipment. Often it is necessary to utilize a plurality of miniature electrical connectors. In these applications, providing for the easy connection and disconnection of wires through the use of connectors allows convenient assembly and maintenance as well as versatility of design. Further, providing for the easy connection and disconnection of a particular wire, without disturbing or otherwise disrupting the connection of surrounding wires, is of importance.

There are a variety of connector constructions currently utilized. One common arrangement involves a plurality of insulation displacement terminals provided in a housing. Insulation displacement terminals interconnect electrical wires having a central conductor portion surrounded by insulation by cutting through or otherwise displacing the insulation of the wires and making physical and electrical contact between the terminal and the conductor portion of the wire.

When a plurality of miniature electrical connectors are located together, the size of the connectors makes installation of electrical wires difficult without a specialized tool. Further, once the miniature electrical connectors are in use in the field, repair and/or removal of specific wires is difficult without the aid of a specialized tool.

None of the conventional constructions of miniature connectors utilizing insulation displacement terminals provides a mechanism for effective installation and removal of a multiplicity of electrical wires. Further, none of the conventional constructions provides an effective way to install and remove specific wires without affecting the connection of surrounding wires. Additionally, none of the conventional constructions provides a mechanism for installation and/or removal of a multiplicity of electrical wires into and/or from a miniature electrical connector assembly without the use of a specialized tool.

Therefore, there exists a need in the industry for a miniature electrical connector design which allows for the easy and effective installation of a plurality of electrical wires and the easy and effective removal of specific wires without affecting surrounding wires. There further is a need for a miniature electrical connector design which allows for effective installation and/or removal of specific wires without the aid of a tool.

SUMMARY OF THE INVENTION

The insufficiencies and disadvantages of the prior art are overcome to a great extent by the present invention, which relates to a miniature electrical connector assembly providing for a plurality of miniature connectors installed in close proximity to one another. The miniature electrical connector assembly includes at least one electrical terminal capable of electrically connecting with a first electrical wire, at least one pivoting assembly capable of receiving the terminal and at least one of the electrical wires and physically and electrically connecting or disconnecting the two upon displacement of the pivoting assembly, and a housing to accommodate the pivoting assemblies and the terminals.

In accordance with a preferred embodiment of the present invention, the pivoting assemblies each include a handle, a pivoting head, and a lower portion. A pair of passages, each adapted to receive a terminal, extends through the lower portion and a pair of channels, each adapted to receive one first electrical wire, extends through the pivoting assembly. Each terminal includes a curved portion having prongs with sharp edges that face one another.

In an aspect of the present invention, at least one first wire is positioned in one of the pivoting assembly channels when the pivoting assembly is in an open position, the pivoting assembly is then pivoted, which allows at least one terminal to be received by at least one passageway of the pivoting assembly lower portion. As the terminal is received, the prongs displace the insulation on the first wire, thereby creating a physical and an electrical connection between the wire and the terminal as the pivoting assembly is pivoted to the closed position.

In another aspect of the present invention, a pulling force may be applied to the first electrical wire when the pivoting assembly is in the closed position, causing the pivoting assembly to be pivoted back to the open position and disconnecting the physical and electrical connection between the wire and the terminal.

In another aspect of the present invention, the miniature connector assembly includes a plurality of pivoting assemblies. Each pivoting assembly may receive two first wires and two terminals.

In another aspect of the present invention, each of the pivoting assemblies is attached to another of the pivoting assemblies and is detachable therefrom to enable construction of a connector of any desired length.

In accordance with another preferred embodiment of the present invention, the miniature connector assembly includes a connector housing which houses a plurality of pivoting assemblies, each being used with a connector, such as a one-ten type connector.

In an aspect of the present invention, each terminal includes two pairs of prongs, the first pair being received in the pivoting assembly for providing electrical connection with a first electrical wire, the second pair being received in the connector for providing electrical connection with a second electrical wire.

The foregoing and other advantages and features of the invention will be more readily understood from the following detailed description of the invention, which is provided in connection with the accompanying drawings.

DETAILED DESCRIPTION OF PREFERRED EMBODIMENTS

Figure 1:
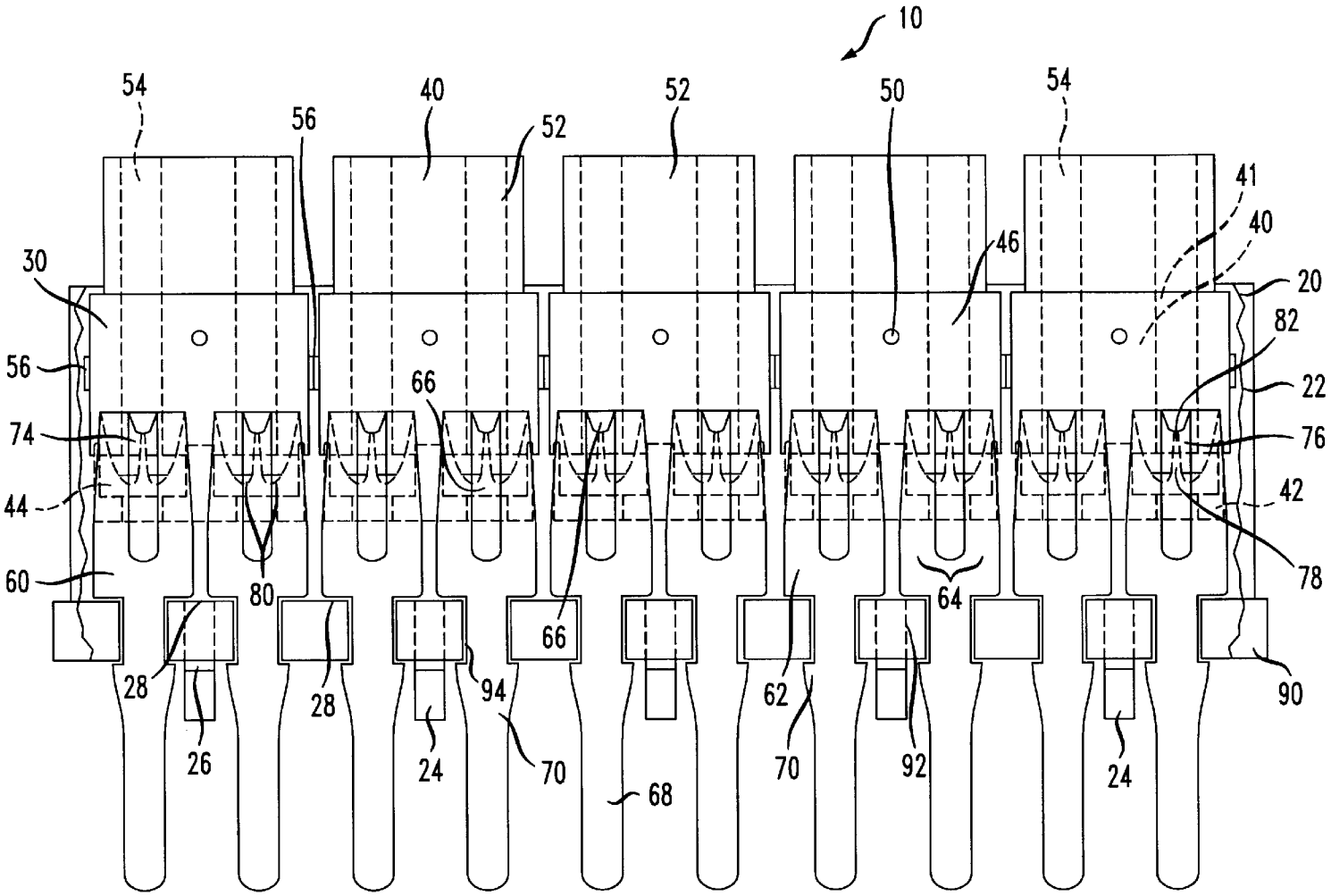
FIG. 1 is a partial front view of a miniature connector assembly constructed in accordance with a preferred embodiment of the present invention, with the front portion of the housing removed for clarity.
Figure 2:
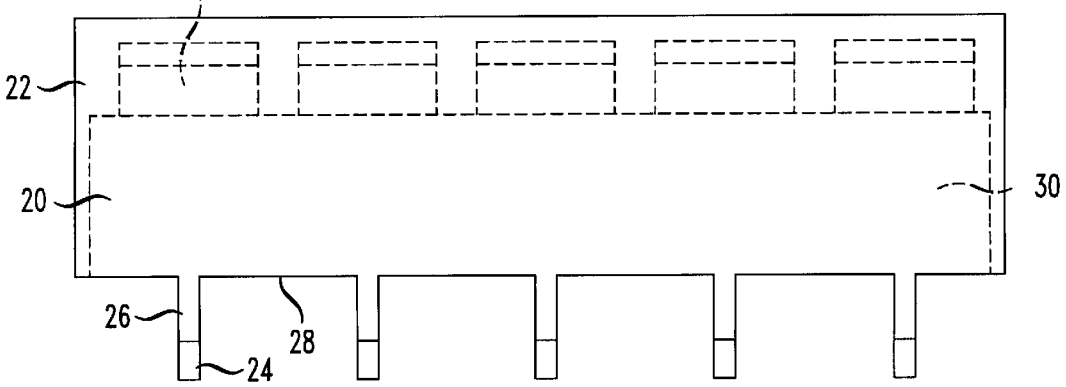
FIG. 2 is a front view of the housing of FIG. 1.

Referring now to FIGS. 1–14, a miniature electrical connector assembly according to a preferred embodiment of the invention is shown. The miniature electrical connector assembly 10 includes a connector housing 20 (partially cut-away in the front view FIG. 1), a plurality of pivoting assemblies 40, a plurality of terminals 60 and a connector base 90.

The connector housing 20 is generally rectangular in shape and includes a pair of sides 22 (FIGS. 1, 5), each side including a plurality of latches 24 extending off of latch legs 26. The connector housing further includes a stop surface 28 positioned adjacent to a cavity 30. The cavity 30 includes a clearance opening 32 at one end of the connector housing 20 farthest from the stop surface 28. As best illustrated in the side views of FIGS. 5 and 8-13, one of the sides 22 includes a shoulder 34. The shoulder 34 includes an inner surface 36 and an outer surface 38 on either side of a curved surface 37.

The cavity 30 is positioned in the interior of the housing 20 between the sides 22, the clearance opening 32 and the stop surface 28. The cavity 30 is adapted, sized, shaped and positioned to be capable of receiving a plurality of pivoting assemblies 40.

Figure 6:
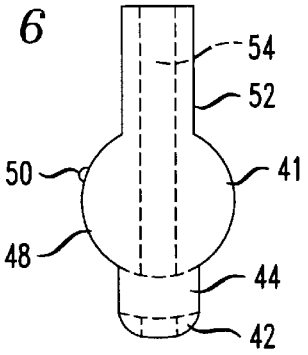
FIG. 6 is a side view of a pivoting assembly of FIG. 1.
Figure 10:
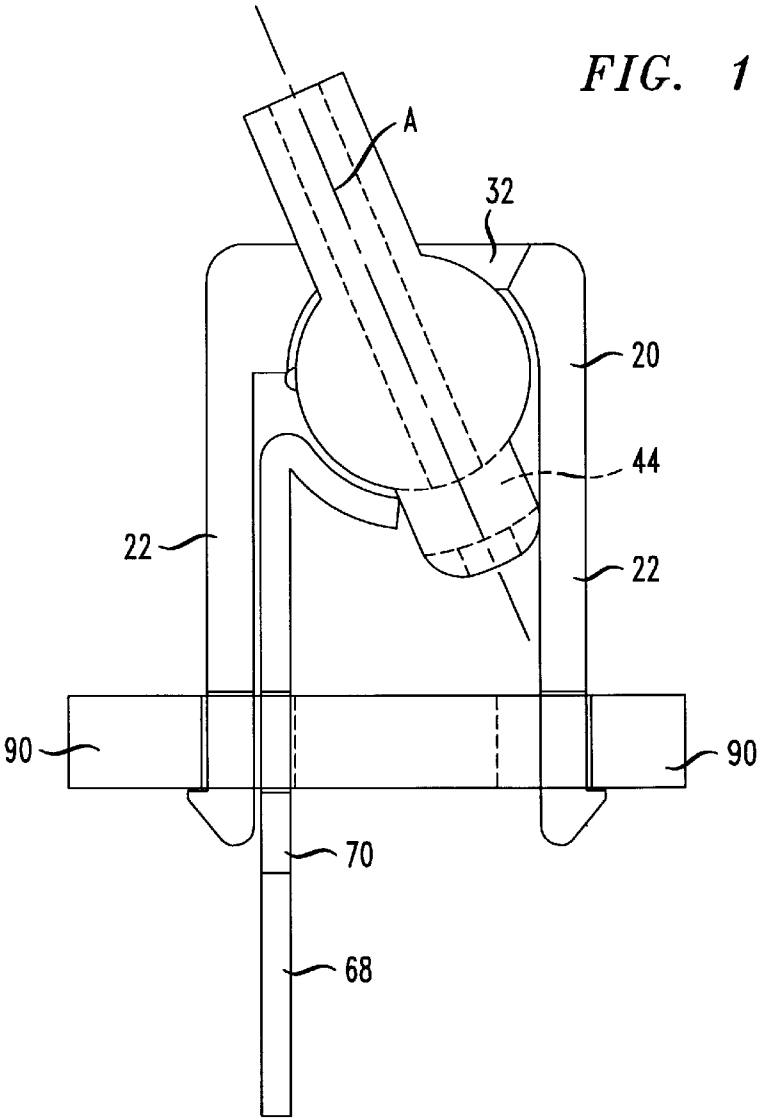
FIG. 10 is a side view of the housing, a pivoting assembly in the open position, and a terminal of FIG. 9, showing the connection of the housing to the base, with a side of the housing removed for clarity.
Figure 14:
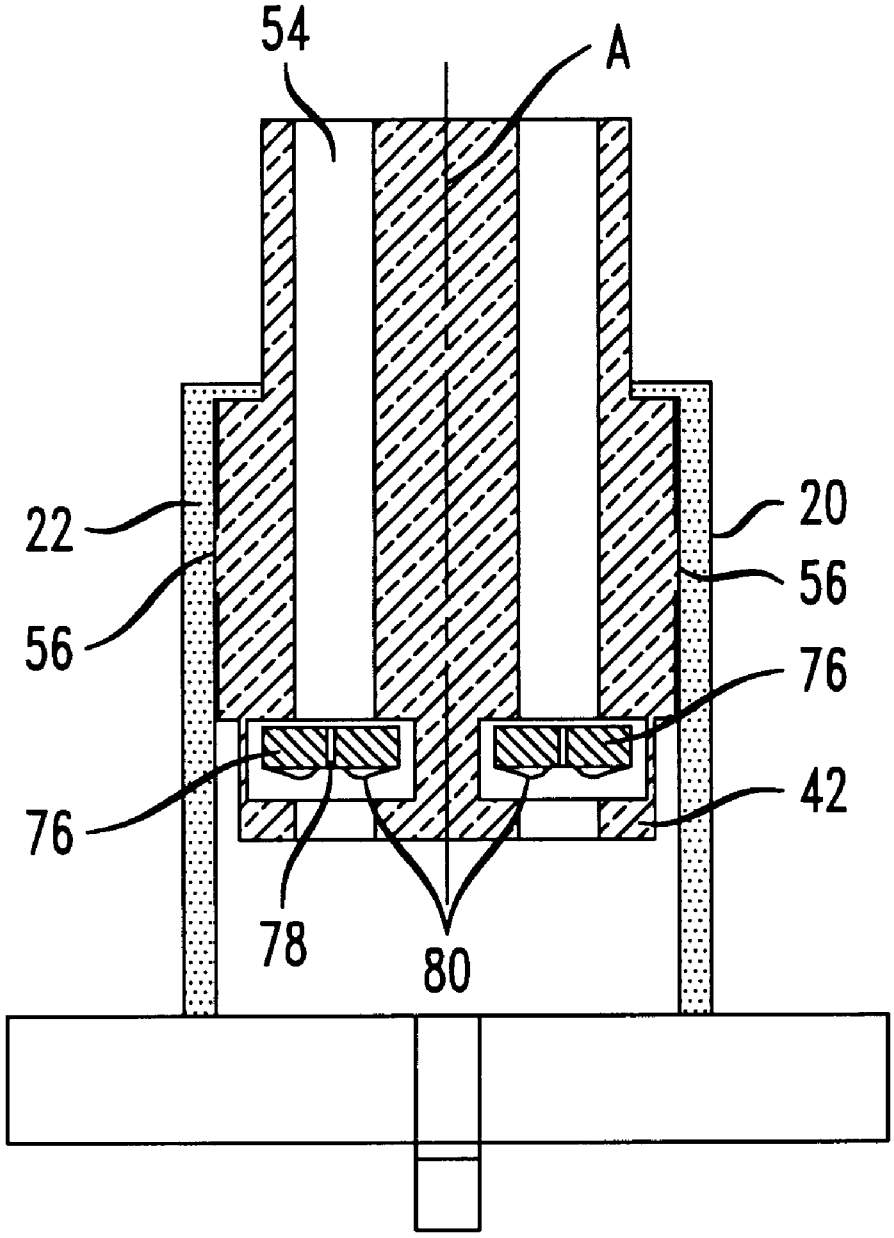
FIG. 14 is a cross-sectional view from the front of the housing, of a single pivoting assembly, and prongs of two terminals of FIG. 1.

Each pivoting assembly 40 includes a pivoting head 41, a lower section 42 and a handle 52 (FIG. 6). When properly installed within the connector housing 20 (FIG. 5), the handle 52 of each pivoting assembly extends through the clearance opening 32. The pivoting head 41 has an outer surface 48 upon which is located a raised nubbin 50. The lower section 42 includes a pair of terminal clearances, or passages, 44. As will be described in greater detail below, the passages 44 act as a clearance for a portion of the terminals 60. Each pivoting assembly includes a longitudinal axis A, as best illustrated in FIGS. 10, 14. Aligned and extending generally parallel to the longitudinal axis A are a pair of side-by-side wire insertion passageways 54 which extend through the handle 52, the pivoting head 41 and the lower section 42. Each of the passageways 54 extends into and through one of the terminal clearances 44 of the lower section 42.

Figure 3:
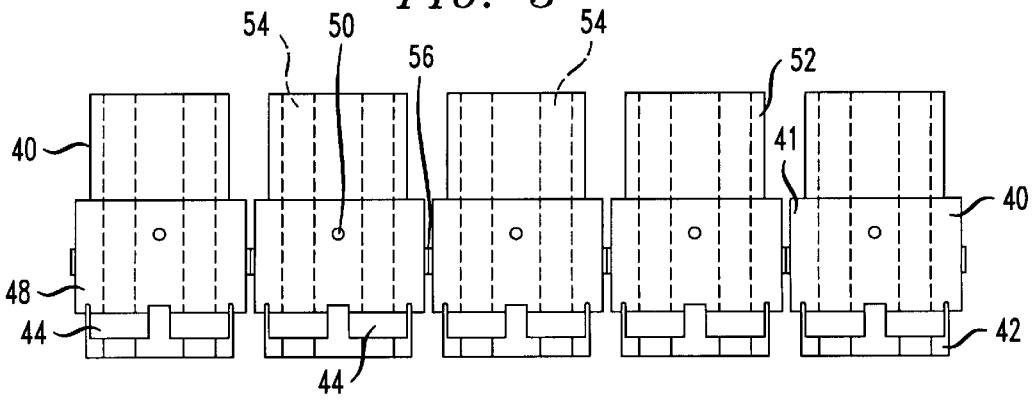
FIG. 3 is a front view of the pivoting assemblies of FIG. 1.

Each pivoting assembly is attached to an adjacent pivoting assembly 40 by way of grooved spacers 56, as best illustrated in FIGS. 1, 3, 14. The grooved spacers 56 are frangible, thereby allowing one pivoting assembly 40 to be easily detached from a neighboring pivoting assembly 40. For example, one pivoting assembly 40 may be pivoted in a downward direction while the adjacent pivoting assembly 40 is pivoted in an upward direction 40, thereby breaking the grooved spacer 56 positioned therebetween.

Figure 7:
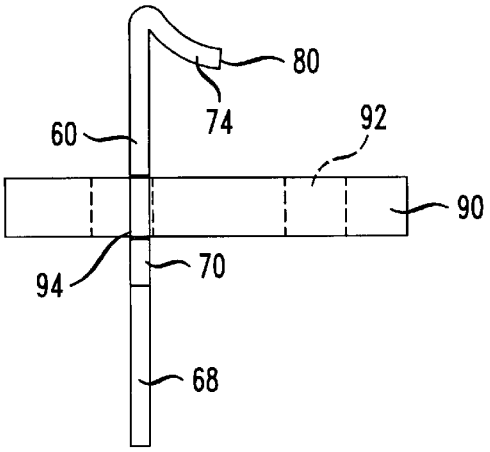
FIG. 7 is a side view of a terminal and the base of FIG. 1.

Each terminal 60 includes a beam 62, a wire wrap tail 68 and a curved portion 74 (FIG. 7). The beam 62 includes a pair of tines 64 separated by a groove 66 (FIG. 1). The tines 64 add flex to terminal 60.

The curved portion 74 of the beam 60 bends down and away from the beam 62. The curved portion 74 is made up of a pair of prongs 76. Each prong 72 includes a guiding tip 80 and a sharp edge 77. The sharp edges 77 face one another and together create a wire interface 78. The wire interface 78 extends up to an embossment 82, which is used to prevent slicing of the conductive portion of a wire. Although any form of embossment 82 may be used, it is preferred to put a dimple on one or both of the tines 64.

Figure 4:
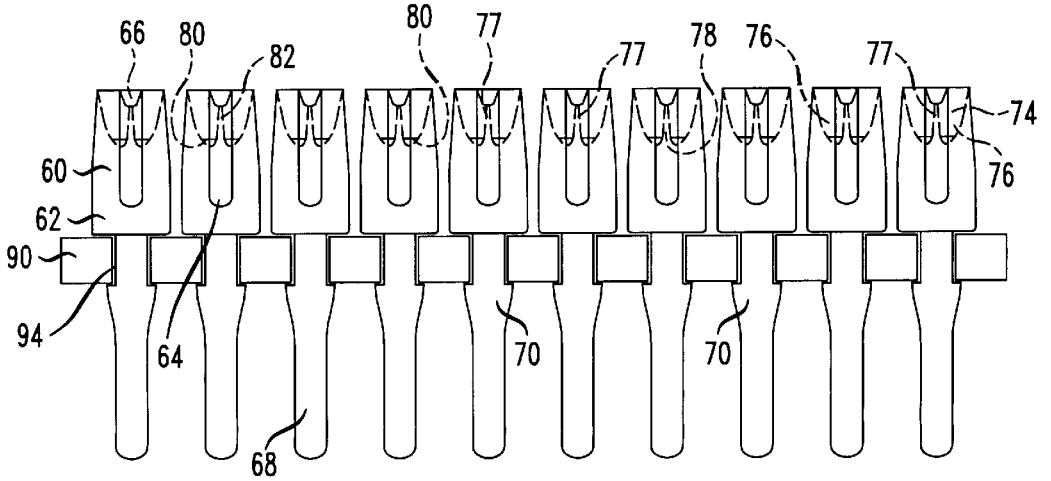
FIG. 4 is a front view of the terminals of FIG. 1.
Figure 5:
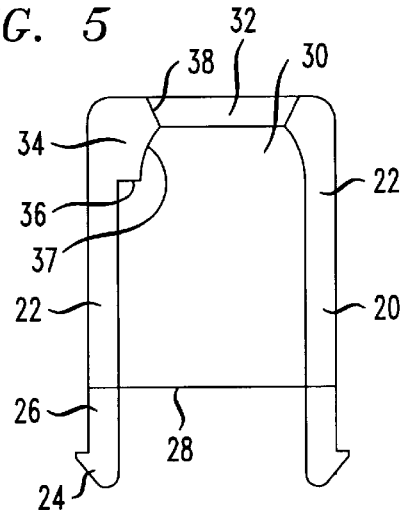
FIG. 5 is a side view of the housing of FIG. 1.
Figure 8:
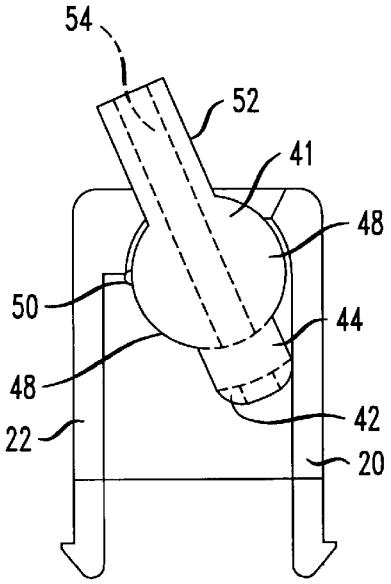
FIG. 8 is a side view of the housing and a pivoting assembly, in the open position, of FIG. 1, with a side of the housing removed for clarity.
Figure 9:
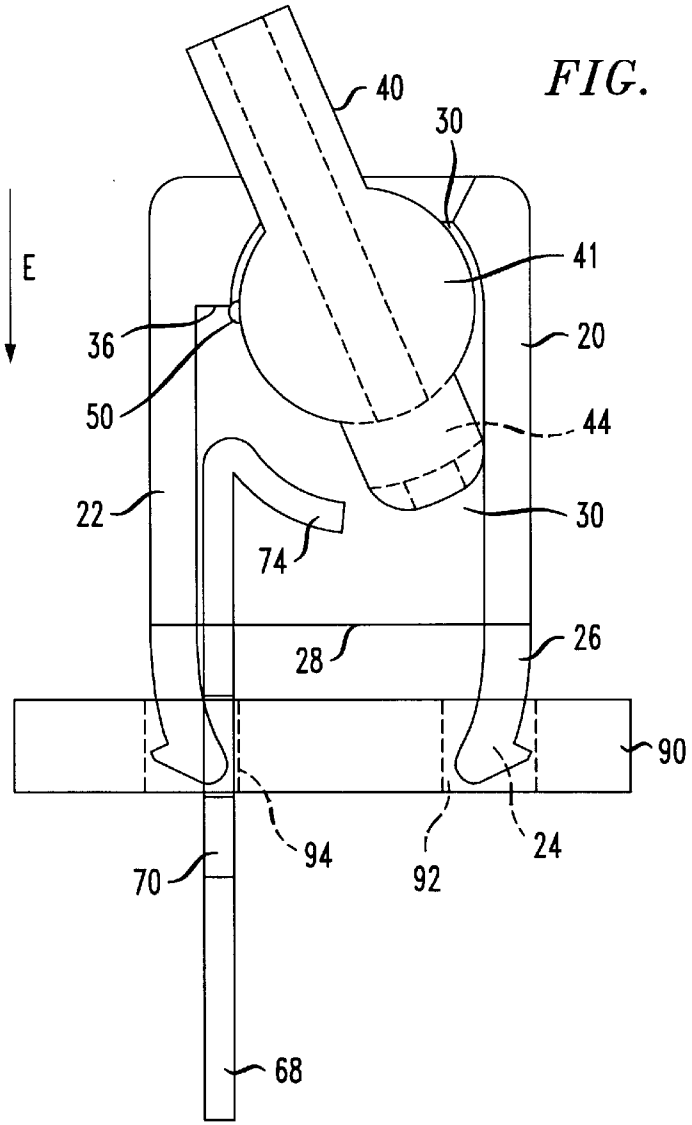
FIG. 9 is a side view of the housing, a pivoting assembly in the open position, and a terminal of FIG. 1, showing the housing being connected to the base, with a side of the housing removed for clarity.

The connector base 90 is generally rectangular in shape and generally coextensive with the housing 20 (FIGS. 1, 4 and 7). The base 90 includes a plurality of latch ways 92 and a plurality of terminal ways 94. Each latch way 92 is sized and shaped so as to be capable of receiving a latch 24 of the connector housing 20. As shown in FIGS. 9-10, the housing 20 is positioned over the base 90 such that each latch 24 is adjacent to a corresponding latch way 92. The housing 20 is then forced down in a general direction E (FIG. 9), forcing the latches 24 into the latch ways 92. The legs 26 may flex inwardly (FIG. 9) as the latches 24 pass through the latch ways 92. Eventually, the latches 24 will exit the latch ways 92 and rest on an exterior of the base 90, with the stop surface 28 resting on an interior of the base 90, thus securing the housing 20 and pivoting assemblies 40 to the base 90.

Each terminal way 94 is positioned and sized so as to be able to receive the wire wrap tail 68 of the terminal 60. Each wire wrap tail 68 includes a retaining barb 70. The retaining barb 70 is a flared portion of the wire wrap tail 68. As the wire wrap tail 68 of one terminal 60 is received by one of the terminal ways 94, the terminal 60 is moved through the terminal way 94 until the retaining barb 70 has traveled through the terminal way 94 and is positioned on an exterior of the base 90. In this position, the terminal 60 is anchored to the base 90.

Figure 13:
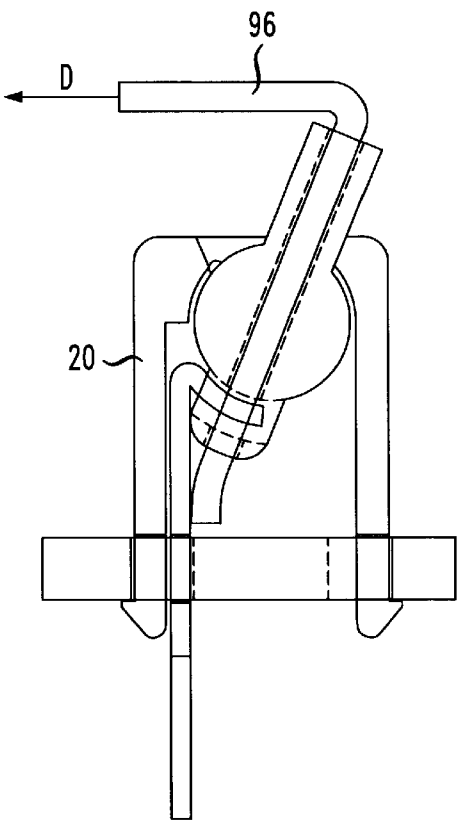
FIG. 13 is a side view of the housing, a pivoting assembly in the closed position, a terminal of FIG. 9 and a first electrical wire, with a side of the housing removed for clarity, showing a method for pivoting the pivoting assembly to the open position.
Figure 12:
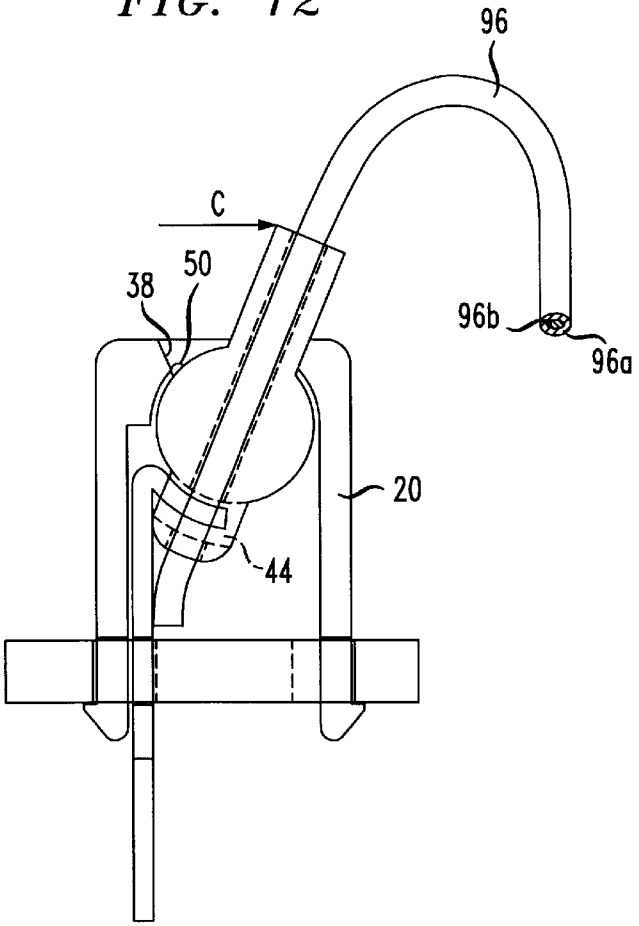
FIG. 12 is a side view of the housing, a pivoting assembly in the closed position, a terminal of FIG. 9 and a first electrical wire, with a side of the housing removed for clarity.
Figure 11:
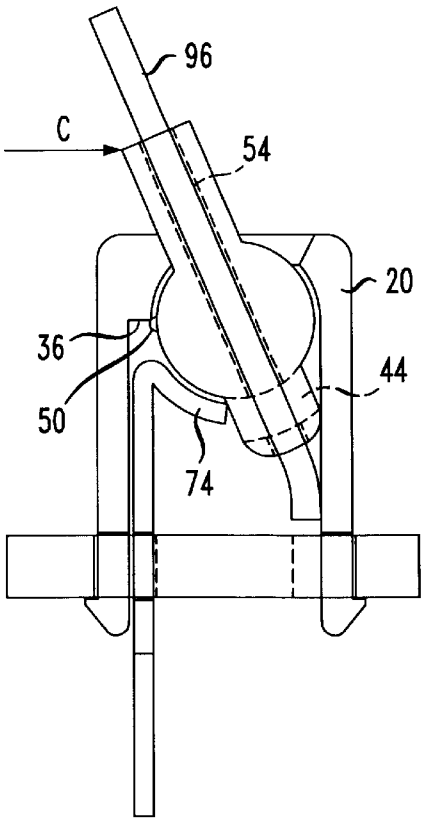
FIG. 11 is a side view of the housing, a pivoting assembly in the open position, a terminal of FIG. 9 and a first electrical wire, with a side of the housing removed for clarity.

As described above, each wire insertion passageway 54 is sized and shaped to accommodate an electrical wire. As best seen in FIGS. 11–13, a wire 96 is placed within a wire insertion passage 54. The wire 96 is formed of an electrically conductive core 96*b* surrounded by an insulative material 96*a*. The wire 96 is inserted in the passageway 54 while the pivoting assembly 40 is in an open position. The open position is characterized by the raised nubbin 50 abutting the inner surface 36 of the shoulder 34 (FIG. 10). The open position is further characterized by the curved portion 74 of the terminal 60 being positioned outside of the terminal clearance 44.

In order to move the pivoting assembly 40 from the open position to a closed position, a force is directed at the pivoting assembly 40 in a general direction C, as best illustrated in FIGS. 11–12. Without a sufficient force, the raised nubbin 50 resting on the inner surface 36 will maintain the pivoting assembly 40 in the open position. A sufficient force in the general direction C will dislodge the raised nubbin 50 from its abutment with the inner surface 36 and impel the dimple 54 along the curved surface 37 to rest on the outer surface 38. As best shown in FIG. 12, the pivoting assembly 40 has now been placed in the closed position. Further, without a sufficient force in a direction D, the raised nubbin 50 resting on the outer surface 38 will maintain the pivoting assembly 40 in the FIG. 12 closed position.

As shown in FIGS. 11–13, while the pivoting assembly 40 is being pivoted from the open position to the closed position, the curved portion 74 of each terminal 60 is extended into one of the terminal clearances 44, through which extends the wire 96. As the prongs 76 of the curved portion 74 enter the clearance 44, the wire 96 is guided into the wire interface 78 by the guiding tips 80. As the prongs 76 move further into the terminal clearances 44 during the pivoting operation, the pair of sharp edges 77 of the prongs 76 slice through the insulative material 96*a*. The embossment 82 assists in preventing the conductive portion 96*b* of the wire 96 from being sliced. In this way, the terminal 60, itself formed of a conductive material, such as, for example, metal, becomes electrically connected with the wire 96.

Although it is shown in FIGS. 11–13 that a single pivoting assembly 40 may be moved from an open position to a closed position, it is to be understood as part of the invention that the entire plurality of pivoting assemblies 40 housed within the connector housing 20 may be moved from an open position to a closed position simultaneously. This is because each pivoting assembly 40 is attached to an adjacent pivoting assembly by way of the grooved spacers 56. Thus, if the grooved spacers 56 between two or more pivoting assemblies 40 have not been broken, the connected assemblies 40 may be pivoted together through the supply of a force C applied to each assembly. Alternatively, each individual pivoting assembly 40 may be individually pivoted from an open to a closed position by first breaking the grooved spacer 56 with its adjacent pivoting assembly 40.

The need will eventually arise for removing, e.g., pulling, a wire 96 from a particular pivoting assembly 40. Next will be described a methodology for easily removing a wire 96 from a pivoting assembly 40 without affecting any of the adjacent pivoting assemblies 40. As best illustrated in FIG. 13, a pulling force is applied on the wire 96 in a general direction D. For example, a particular wire 96 which is desired to be removed from the pivoting assembly 40 can be manually pulled in the direction D. Because a portion of the wire 96 is wedged in tightly between the pair of sharp edges 77 of the prongs 76, the force applied in a direction D will have the effect of dislodging the raised nubbin 50 from the outer surface 38 and allowing relocation of the pivoting assembly 40 to the open position as shown in FIG. 11. Once in the open position, or upon the wire 96 becoming dislodged from the wire interface 78, the wire 96 can be easily pulled from the wire insertion passageway 54 of the pivoting assembly 40.

Relocating a pivoting assembly 40 back to the open position may allow two wires 96 to be simultaneously removed from the wire insertion passageways 54 of the pivoting assembly 40 by pulling on adjacent wires 96. However, because each of the wires 96 in a single pivoting assembly 40 are positioned within its own passageway 54, pulling of one of the wires 96 will be possible without affecting the position of the adjacent wire 96. If the pivoting assembly 40 from which the wire 96 is being pulled has not been dislodged from its adjacent pivoting assembly 40, the adjacent pivoting assembly 40 will also be in the open position, but pulling of one or both of the wires 96 from one assembly 40 should not affect the position of the wires 96 in the adjacent assembly 40. Alternatively, the pivoting assembly 40 from which a wire 96 is desired to be removed may first be dislodged from its adjacent pivoting assembly and then moved to the open position as shown in FIG. 11. Through this alternative operation, a wire 96 can be pulled from a pivoting assembly 40 without disrupting the closed position of the adjacent pivoting assemblies 40. In this way, a single circuit can be opened without opening any circuits in adjacent pivoting assemblies 40.

The wire wrap tail 68 (FIG. 1) may further be electrically connected either to a second wire (not shown), or soldered to a printed wiring board. Through either arrangement, the miniature electrical connector assembly 10 may be electrically connected to an electric circuit.

Figure 21:
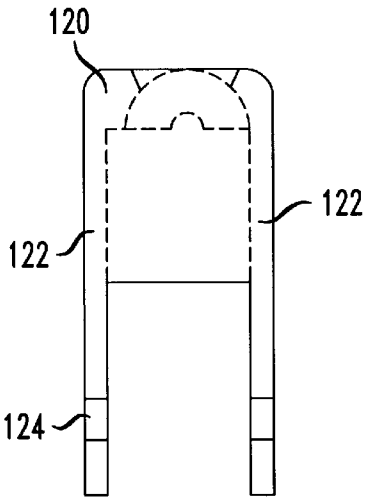
FIG. 21 is a side view of the housing of the miniature connector assembly of FIG. 15.
Figure 22:
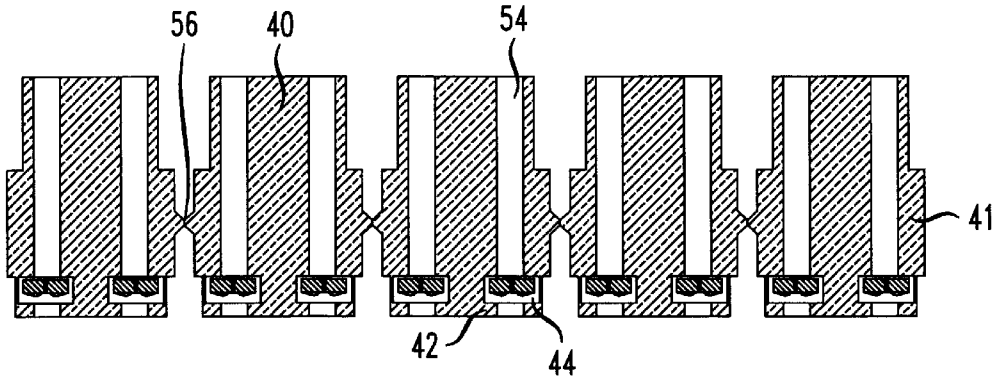
FIG. 22 is a cross-sectional front view of a plurality of pivoting assemblies of the miniature connector assembly of FIG. 15.
Figure 23:
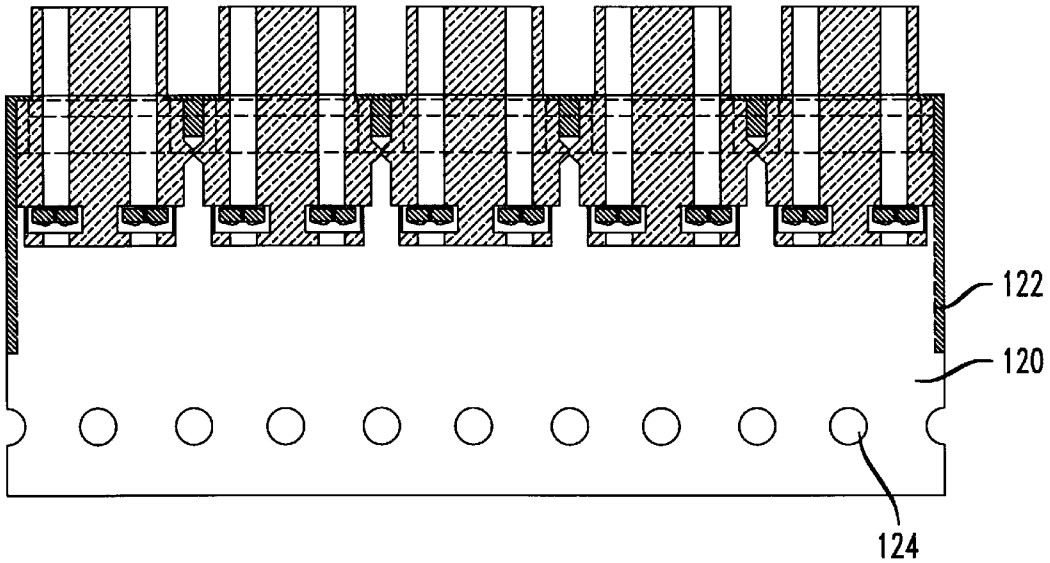
FIG. 23 is a cross-sectional front view of a plurality of pivoting assemblies and the housing of the miniature connector assembly of FIG. 15.

With reference to FIGS. 15–23, a retrofit miniature connector assembly 100 constructed in accordance with another preferred embodiment of the present invention is illustrated. As with the first preferred embodiment illustrated in FIGS. 1–14, the retrofit assembly 100 includes a housing 120 and a plurality of pivoting assemblies 40 (FIG. 22). The housing 120 differs slightly from the housing 20. The housing 120 includes a pair of sides 122 (FIG. 21). The sides 122 include a plurality of raised nubbin openings 124. As will be described further below, the connector housing 120 is adapted to interconnect with a plurality of connectors 110.

Figure 17:
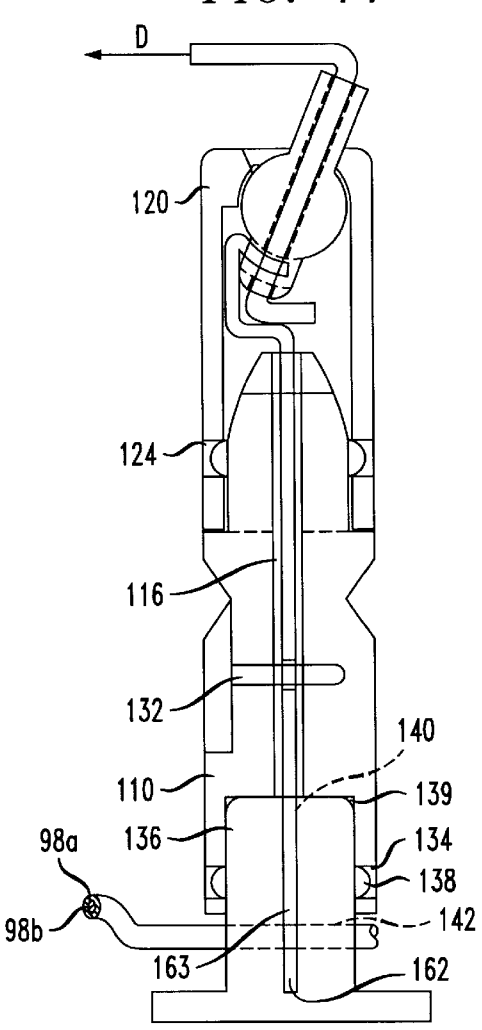
FIG. 17 is a side view of the miniature connector assembly of FIG. 15, showing a method for pivoting the pivoting assembly to the open position.
Figure 16:
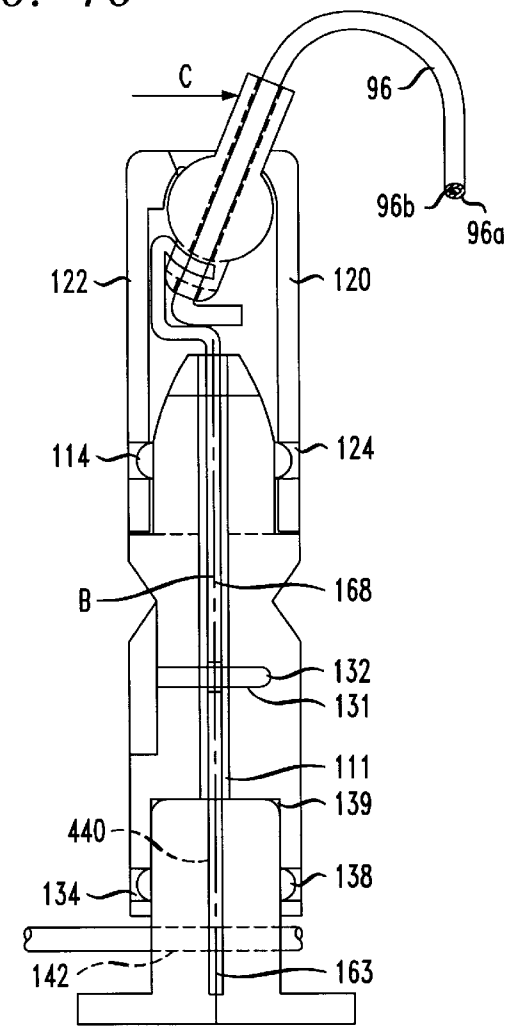
FIG. 16 is a side view of the miniature connector assembly of FIG. 15 shown in the closed position.
Figure 15:
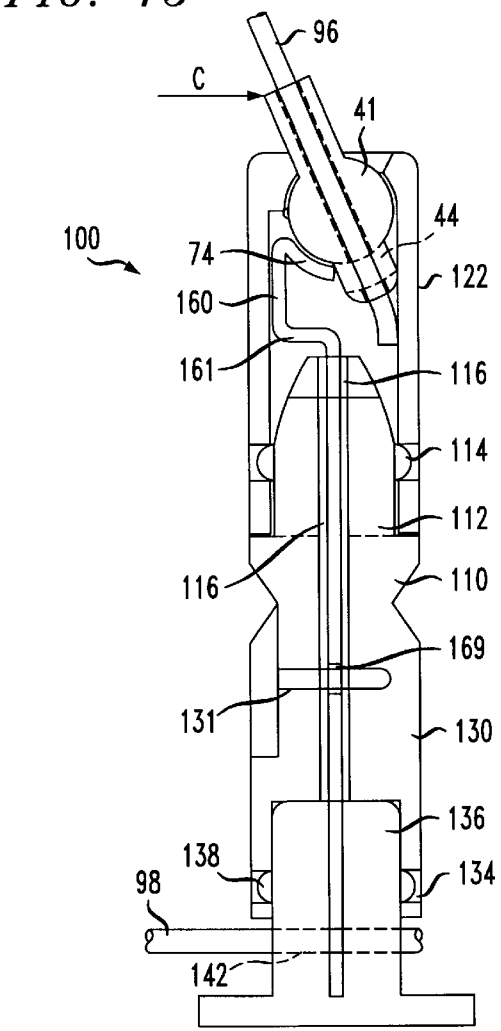
FIG. 15 is a side view of a miniature connector assembly constructed in accordance with another preferred embodiment of the present invention.
Figure 18:
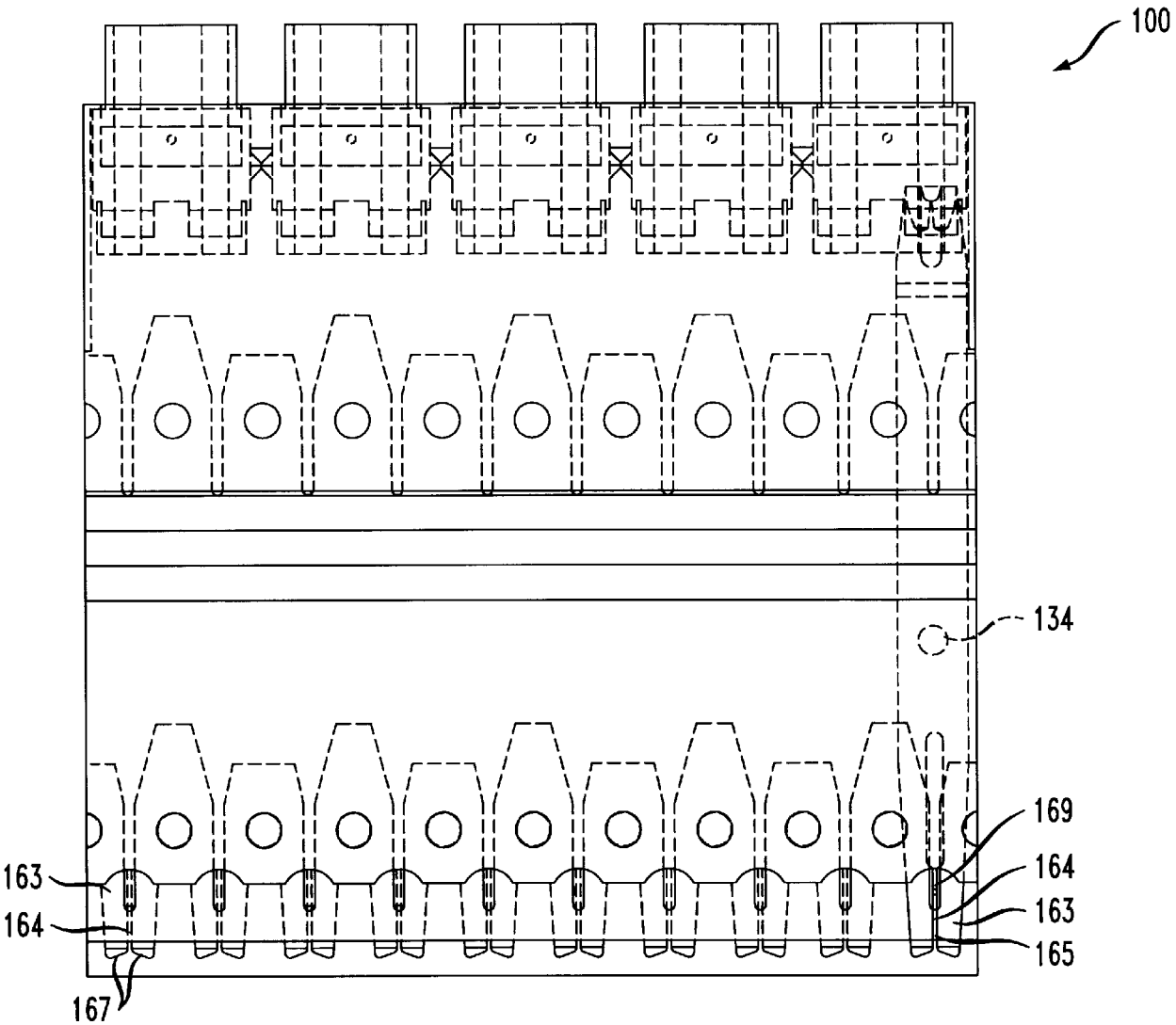
FIG. 18 is a front view of the miniature connector assembly of FIG. 15.
Figure 19:
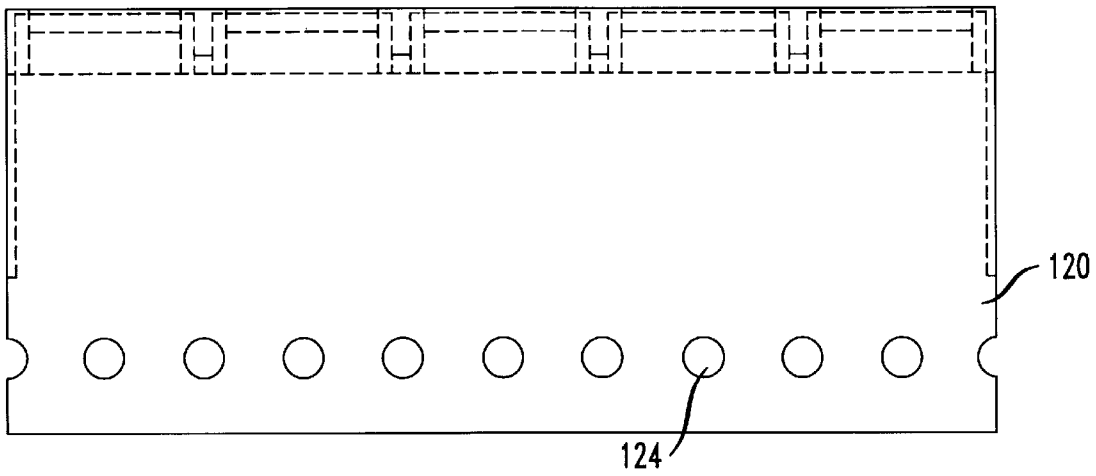
FIG. 19 is a front view of the housing of the miniature connector assembly of FIG. 15.
Figure 20:
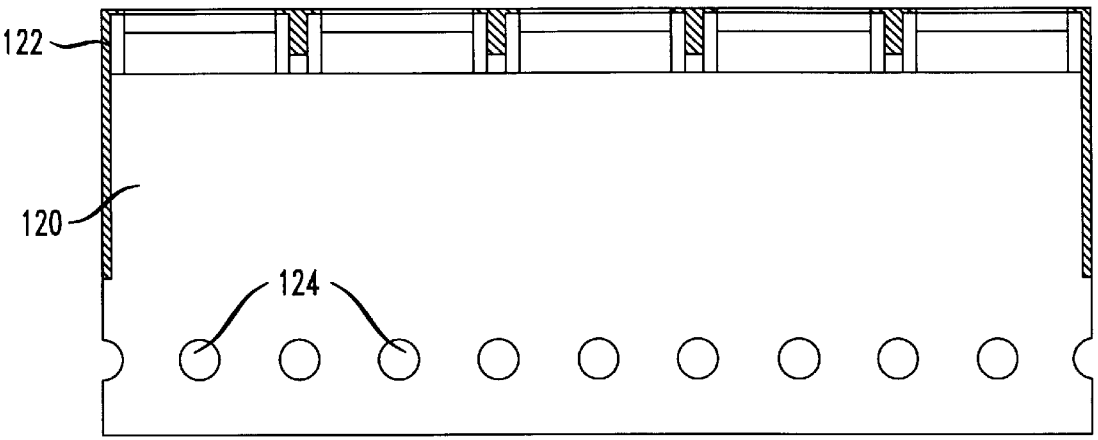
FIG. 20 is a partial cross-sectional front view of the miniature connector assembly of FIG. 15.

Each connector 110 includes a head 112, having a pair of raised nubbin 114, and a body 130 (FIGS. 15–17). The body 130 has an outer extent roughly equivalent to the outer extent of the two sides 122 of the connector housing 120. A terminal opening 116 extends throughout the connector 110 roughly along a longitudinal axis B (FIG. 16). The terminal opening 116 is sized and shaped to accept a terminal 160 (to be described in greater detail below). A retainer orifice 131 extends through the body 130 generally transverse to the longitudinal axis B. The retainer orifice 131 is sized and shaped to accept a retainer 132 (to be described in further detail below). A pair of raised nubbin openings 134 and a cavity 139 are positioned at an end of the body 130 farthest from the head 112. The cavity 139 is sized and shaped so as to be capable of receiving a wire holder 136. The wire holder 136, such as a one-ten index strip 136, functions to receive and hold a wire, such as wire 98, while the terminal 160 is brought into contact with and displaces the insulation of the wire 98.

The connector 110 illustrated is a one-ten type connector 110. The one-ten type connector 110 includes a plurality of wiring blocks with detachable legs and is useful in terminating wires having a diameter of about 0.40 millimeters to about 0.63 millimeters.

The index strip 136 includes a pair of raised nubbin 138, a terminal opening 140 (FIGS. 16, 17) coextensive with the terminal opening 116, and a wire insertion passageway 142 sized and shaped to accommodate a second wire 98.

The terminal 160 includes a curved portion 74 having a pair of prongs 76, as described above in regard to the first preferred embodiment. The terminal 160 further includes a bend 161 which allows the tail end of the terminal 160 to be centered within the connector housing 120 so that it may be received in the terminal openings 116, 140. At the end 162 opposite from the curved portion 74 of the terminal 160 is a pair of prongs 163, each having a sharp edge 164 facing the other and creating a wire interface 165 therebetween, and a pair of guiding tips 167. An orifice 169 is positioned within the body of the terminal 160. More specifically, the orifice 169 is positioned such that when the terminal 160 is properly positioned within the connector housing 120, the orifice 169 is aligned with and coextensive with the retainer opening 131. A retainer 132 may be placed within the retainer opening 131 and through the orifice 169, thereby anchoring the terminal 160 to the connector 110. Preferably, the retainer 132 is ultrasonically welded into the retainer opening 131.

The second wire 98, like the first electric wire 96, includes a conductive portion 98*b* surrounded by an insulative portion 98*a*. Once the second wire 98 is positioned within the wire insertion passageway 142, the index strip 136 can be positioned within the cavity 139 of the body 130, thus allowing the dimple openings 134 to receive the raised nubbin 138. As the index strip 136 is thus being snapped into position, the second wire 98 is guided by the guiding tips 167 into the wire interface 165 between the two sharp edges 164, thereby cutting the insulative material 98*a* and creating an electrical contact between the terminal 160 and the second wire 98. The second wire 98 may be connected to a power source or further connected to an electrical circuit.

The pivoting portion of the assembly 100 works similar to the pivoting portion of the assembly 10. Specifically, the pivoting assembly 40 may be pivoted by a force C from an open position to a closed position. In the open position, the passage 44 is positioned at a distance from the curved portion 74 of the terminal 160. As the pivoting assembly 40 is pivoted toward the closed position, the passage 44 swings toward the curved portion 74, allowing the curved portion 74 to enter. The wire 96, which has been snaked through the wire insertion passageway 54, makes contact with the prongs 76 of the curved portion 74. The sharp edges 77 of the prongs 76 slice through and/or displaces the insulative portion 96*a* of the wire 96, thereby electrically connecting the terminal 160 with the wire 96.

Through this arrangement, a connector assembly can be replaced in the field without the aid of a specialized tool, such as a 788J1 tool, which is an impact tool designed to terminated and cut UTP cable and to seat three, four and five pair one-ten type connecting blocks. The 788J1 tool terminates conductors on the cable side and the cross-connect side of the one-ten type connecting blocks.

The above description and drawings are only illustrative of certain preferred embodiments which achieve the objects, features and advantages of the present invention. It should be understood that many changes can be made to the disclosed embodiment and equivalent elements substituted for described elements without changing the spirit or scope of the invention. Accordingly, the invention is not limited by the foregoing description but is only limited by the scope of the appended claims.

What is claimed as new and desired to be protected by Letters Patent of the United States is:

1. A miniature connector assembly, comprising:

at least one electrical terminal, each said terminal being adapted to engage and electrically connect with a first electrical wire;

at least one pivoting assembly adapted to receive said at least one terminal and at least one said first electrical wire, each said pivoting assembly being adapted to pivot between an open position and a closed position, wherein in said open position said at least one said first electrical wire is disengaged from said terminal and in said closed position said at least one said first electrical wire is engaged and electrically connected with said terminal; and a housing which houses said at least one pivoting assembly and said at least one terminal, wherein said housing includes a cavity adapted to receive said at least one pivoting assembly, said cavity including an opening, and a shoulder positioned adjacent said opening and having an inner and an outer surface, said pivoting assembly including pivoting head having a raised nubbin on an outer surface thereof, said raised nubbin abutting said inner surface when said pivoting assembly is in said open position and said raised nubbin moving across said shoulder and abutting said outer surface when said pivoting assembly is in said close position.

2. The connector assembly of claim 1, including two terminals for each said pivoting assembly, wherein a pair of channels extend through said pivoting assembly, each said channel being adapted to receive a respective said first wire.

3. The connector assembly of claim 2, wherein each said pivoting assembly includes:

a handle; and a lower portion;

wherein said pivoting head is adapted to move between said open position where said terminals are disengaged from said first wires respectively and said closed position where said terminals respectively engage and electrically connect with said first wires.

4. The connector assembly of claim 3, wherein said handle extends through said opening.

5. The connector assembly of claim 4, wherein each said terminal includes a curved portion having a pair of first prongs adapted to provide electrical connection between said terminal and one of said first wires, and said connector assembly further comprises a pair of passages in said lower portion, each said passage being adapted to receive said curved portion when said head is pivoted to said closed position.

6. The connector assembly of claim 5, wherein said first prongs face one another and each said first prong includes a sharp inwardly facing edge adapted to displace insulation from said first wire to enable electrical connection between said terminal and said first wire during said pivoting of said head.

7. The connector assembly of claim 6, wherein each said pivoting assembly is adapted to be pivoted from said closed position to said open position by exertion of a pulling force on said first wire.

8. The connector assembly of claim 7, wherein each said passage is pivoted away from each said curved portion when said pivoting assembly is pivoted from said closed position to said open position, disengaging said terminals from said first wires.

9. The connector assembly of claim 8, further including a base adapted to receive said housing and said terminals.

10. The connector assembly of claim 9, wherein said housing includes a plurality of latching devices which connect said housing with said base.

11. The connector assembly of claim 10, wherein each said latching device includes a leg having a protrusion extending outwardly from an end of said leg.

12. The connector assembly of claim 9, wherein said base includes a plurality of openings, each said opening adapted to receive one of said terminals.

13. The connector assembly of claim 12, wherein each said terminal includes a tail portion having a flared section, each said opening adapted to allow passage of said flared section therethrough and to inhibit removal of said terminal therefrom.

14. The connector assembly of claim 13, including a plurality of said pivoting assemblies, wherein said pivoting assemblies are detachably attached to each other.

15. The connector assembly of claim 14, wherein at least one pivoting assembly is attached to at least one other said pivoting assembly.

16. The connector assembly of claim 14, wherein each said terminal includes a tail adapted for connection to a printed wiring board.

17. The connector assembly of claim 14, wherein each said terminal includes a tail adapted for engaging a second electrical wire.

18. The connector assembly of claim 17, wherein each said tail engages said second electrical wire by wrapping said electrical wire around said tail.

19. A retrofit connector assembly including the miniature connector assembly of claim 8, further comprising a second connector assembly having at least one connector, each said connector adapted to mate with said housing and including:

a head; and a body;

wherein a passage extends through said head and said body of each said connector, each said passage receiving a respective said terminal.

20. The retrofit assembly of claim 19, wherein each said terminal includes:

a transverse portion; and a tail portion having a second pair of prongs adapted to provide electrical connection between said terminal and a second electrical wire.

21. The retrofit assembly of claim 20, further including at least one wire holder, each said wire holder including:

a passage extending through and coextensive with said connector passage, said second pair of prongs of said terminal being received by said wire holder passage; and a channel adapted to receive said second wire, wherein said channel transverses said wire holder passage to allow engagement of said second wire by said second pair of prongs.

22. The retrofit assembly of claim 21, wherein said second prongs face one another and each said second prong includes a sharp inwardly facing edge adapted to remove insulation from said second wire.

23. The retrofit assembly of claim 22, wherein said wire holder is an index strip.

24. The retrofit assembly of claim 22, wherein each said connector body includes:

a retainer for retaining said terminal within said connector; and a retainer orifice for receiving said retainer.

25. The retrofit assembly of claim 24, wherein said retainer orifice extends transverse to said connector passage and wherein each said terminal tail portion has an orifice for receiving said retainer.

26. The retrofit assembly of claim 25, wherein each said head includes a pair of raised nubbins and said housing includes a plurality of pairs of openings, each said opening adapted to receive a respective raised nubbins of a said head.

27. The retrofit assembly of claim 26, wherein each said wire holder includes a pair of raised nubbins and each said body includes a pair of openings, each said opening adapted to receive a respective raised nubbins of said wire holder.

28. The retrofit assembly of claim 27, including a plurality of said pivoting assemblies, each said pivoting assembly lower portion passage being adapted to receive one of said terminals and each said pivoting assembly channel being adapted to receive one of said first wires.

29. The retrofit assembly of claim 28, including:

a plurality of said connectors, each said connector adapted to receive one said terminal; and a plurality of said wire holders, one said connector being physically connected with each said wire holder, each said wire holder adapted to receive one said terminal and one said second wire.

30. The retrofit assembly of claim 29, wherein said pivoting assemblies are detachably attached to each other.

31. The retrofit assembly of claim 29, wherein said connectors are one-ten type connectors.

32. A miniature connector retrofit kit, comprising:

at least one electrical terminal, each said terminal being adapted to engage and electrically connect with a first electrical wire and a second electrical wire;

at least one pivoting assembly adapted to receive said at least one terminal and at least one said first electrical wire, each said pivoting assembly being adapted to pivot between an open position and a closed position, wherein in said open position said at least one said first electrical wire is disengaged from said terminal and in said closed position said at least one said first electrical wire is engaged and electrically connected with said terminal;

a housing which houses said at least one pivoting assembly and said at least one terminal; and a retrofit connector assembly including at least one connector, each said connector adapted to mate with said housing and including:

a head; and a body;

wherein a connector passage extends through said head and said body of each said connector, each said passage receiving a respective said terminal.

33. The connector retrofit kit of claim 32, wherein each said terminal includes:

a curved portion having a pair of first prongs adapted to provide electrical connection between said terminal and one of said first wires; and a tail portion having a second pair of prongs adapted to provide electrical connection between said terminal and one of said second electrical wires.

34. The connector retrofit kit of claim 33, including:

a pair of passages in said at least one pivoting assembly, each said passage being adapted to receive said curved portion when said pivoting assembly is in said closed position; and at least one wire holder, each said wire holder including:

a passage extending through and coextensive with said connector passage, said second pair of prongs of said terminal being received by said wire holder passage; and a channel adapted to receive said second wire, wherein said channel transverses said wire holder passage to allow engagement of said second wire by said second pair of prongs.

35. A method of providing an electrical connection between an electrical terminal received by a pivoting element with a pivoting head and a wire, comprising the steps of:

holding said terminal stationary within said housing, wherein said housing includes a shoulder positioned adjacent an opening and having an inner and an outer surface;

placing said wire in said pivoting element while said pivoting element is in a first rest position;

moving said pivoting element to a second rest position causing said wire to physically and electrically engage with said stationary terminal as said pivoting element moves to said second rest position, said pivoting head having a raised nubbin on an outer surface thereof, said raised nubbin abutting said inner surface when said pivoting element is in said first rest position and said raised nubbin moving across said shoulder and abutting said outer surface when said pivoting element is in said second rest position.

36. The method of claim 35, wherein said pivoting element includes:

a handle;

a pivoting head; and a lower portion;

wherein a pair of channels extend through said pivoting assembly, each said channel being adapted to receive one said wire.

37. The method of claim 36, wherein each said terminal includes a curved portion having a pair of prongs adapted to provide electrical connection between said terminal and said wire.

38. The method of claim 37, wherein a pair of passages extend through said pivoting assembly lower portion, each said passage being adapted to receive said terminal curved portion.

39. The method of claim 38, wherein the step of moving said pivoting element from said first rest position to said second rest position includes the substep of:

said wire extending through one of said pivoting assembly channels in said first rest position, said pivoting assembly is pivoted to said second rest position, wherein during said pivoting of said pivoting assembly said lower portion moves toward said curved portion and said curved portion extends through one of said lower portion passages coming into contact and electrically connecting with said wire.

40. The method of claim 39, wherein said first prongs face one another and each said first prong includes a sharp inwardly facing edge adapted to displace insulation from said wire to enable electrical connection between said terminal and said wire during said step of pivoting said pivoting assembly.

41. The method of claim 40, further including the step of pivoting each said pivoting assembly from said second rest position to said first rest position by exerting a pulling force on said wire, disengaging said terminal from said wire.

42. The method of claim 41, wherein a plurality of said pivoting assemblies are positioned within a housing, each said pivoting assembly being detachably attached to each other.

43. The method of claim 42, further including the step of detaching each said pivoting assembly from the other said pivoting assemblies.

44. The method of claim 43, further including the step of electrically connecting each said terminal tail to a printed wiring board.

45. The method of claim 44, further including the step of connecting each said pivoting assembly with a connector, each said connector including:

a head; and a body;

wherein a passage extends through said head and said body of each said connector, said passage receiving said terminal.

46. The method of claim 45, further including the step of electrically connecting said terminal with a second wire.

47. The method of claim 46, wherein said terminal includes a second pair of prongs adapted to provide electrical connection between said terminal and a second electrical wire and said step of electrically connecting said terminal with said second wire includes:

connecting a wire holder to said body of said connector, said wire holder including a passage extending through and coextensive with said connector passage, and a channel in which said second wire is received, wherein said channel transverses said wire holder passage to allow engagement of said second wire by said second pair of prongs.

48. The method of claim 46, wherein said second prongs are received by said wire holder and said second prongs face one another, each said second prong including a sharp inwardly facing edge adapted to displace insulation from said second wire to enable electrical connection between said terminal and said second wire.

* * * * *